US006866518B1

(12) United States Patent
Korsunsky et al.

(10) Patent No.: US 6,866,518 B1
(45) Date of Patent: Mar. 15, 2005

(54) ELECTRICAL INTERCONNECTION BETWEEN MULTIPLE PRINTED CIRCUIT BOARDS

(75) Inventors: Iosif R. Korsunsky, Harrisburg, PA (US); Tod M. Harlan, Mechanicsburg, PA (US); Brian J. Gillespie, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/669,968

(22) Filed: Sep. 23, 2003

(51) Int. Cl.[7] ..... H01R 12/00
(52) U.S. Cl. ..... 439/61; 439/637
(58) Field of Search ..... 439/635, 637, 439/65, 64, 61, 74, 631, 632, 630, 62, 326, 439/701, 608, 629; 361/784, 788, 736

(56) References Cited

U.S. PATENT DOCUMENTS 4,572,604 A * 2/1986 Ammon et al. ..... 439/633
4,838,798 A * 6/1989 Evans et al. ..... 439/61
5,356,301 A 10/1994 Champion et al.
5,402,078 A * 3/1995 Hamilton ..... 324/760
5,754,411 A * 5/1998 Woychik ..... 361/803
5,993,259 A 11/1999 Stokoe et al.
6,083,047 A 7/2000 Paagman
6,128,201 A * 10/2000 Brown et al. ..... 361/784
6,267,604 B1 7/2001 Mickievicz et al.
6,422,876 B1 * 7/2002 Fitzgerald et al. ..... 439/61
6,508,675 B1 1/2003 Korsunsky et al.
6,540,522 B2 4/2003 Sipe

* cited by examiner

*Primary Examiner*—Alex Gilman
(74) *Attorney, Agent, or Firm*—Wei Te Chung

(57) ABSTRACT

An electrical interconnection system includes a first printed circuit board (20) defining a receiving slot (22), a second printed circuit board (30) assembled to the first printed circuit board and having an edge (30*a*) received in the receiving slot, and an electrical connector (1) electrically connecting with the first and the second printed circuit boards. The connector includes contacts (12) having first ends (12*a*) moveably contacting with the first printed circuit board, and second ends (12*b*) moveably contacting with the second printed circuit board. A method of interconnecting the first and the second printed circuit boards is also disclosed.

24 Claims, 16 Drawing Sheets

ELECTRICAL INTERCONNECTION BETWEEN MULTIPLE PRINTED CIRCUIT BOARDS

CROSS-REFERENCE TO RELATED APPLICATIONS

Relevant subject matter is disclosed in contemporaneously filed U.S. Patent Applications entitled "ELECTRICAL CONNECTOR FOR INTERCONNECTING TWO INTERSECTED PRINTED CIRCUIT BOARDS" and entitled "METHOD FOR INTERCONNECTING MULTIPLE PRINTED CIRCUIT BOARDS", both of which are assigned to the same assignee with this application.

BACKGROUND OF THE INVENTION

1. Field of the Invention

The present invention relates to an electrical interconnection, and more particularly to an interconnection within an electrical system in which a plurality of motherboards and a plurality of daughter boards are installed and arranged in a matrix form.

2. Description of Related Art

Various electronic systems, especially a telecommunication system, servers and switches, comprise a wide array of components mounted on printed circuit boards, such as daughterboards and motherboards. The motherboard to which the daughterboards are connected are generally referred to as backplane as it is stationary. Connectors used to assemble the daughterboards, which are removable, to the motherboards are referred to as backplane connectors. The motherboard and the daughterboard are interconnected by the connectors so as to transfer signals and power throughout the systems.

Typically, the motherboard, backplane, is a printed circuit board that is mounted in a server or a switch and is provided with a plurality of backplane connectors. Multiple daughterboards are also each provided with a mating connector and then removeably plugged into the connectors on the backplane. After all the daughterboards are interconnected to the backplane, the daughterboards are interconnected through the backplane and are arranged parallel to each other.

However, connecting the daughterboards via the backplane leads to the potential for signal interference. Because the daughterboards are all connected via the backplane, signal strength may be attenuated as signals travel through the backplane. In general, signals passing between two daughterboards pass through at least a first connector pair between a first daughterboard and the backplane, and a second connector pair between the backplane and a second daughterboard. In general, the signal passes through totally two pairs of mated connectors, and each time the signal is attenuated as it passes.

Generally, the arrangement between the backplane and the daughterboard can be referred to as a "TTTT" type viewed from atop, i.e. the backplane is arranged in a horizontal direction, while the daughterboard is arranged in a position perpendicular to the backplane. In some cases, both sides of the backplane are all provided with connectors for assembling the daughterboards from both sides. This arrangement can be referred to as a "++++" type viewed from atop. In this arrangement, the daughterboards arranged in both sides are in communication with each other through the motherboard, i.e. centerplane.

Many connectors have been provided for achieving such arrangement. U.S. Pat. No. 5,993,259 (the '259 patent) issued to Stokoe et al. discloses an electrical connector of such application. The connector disclosed in the '259 patent includes a plurality of modularized wafers bounded together. As shown in FIG. 4 of the '259 patent, the terminals are stamped from a metal sheet and then embedded within an insulative material to form the wafer.

U.S. Pat. No. 6,083,047 issued to Paagman discloses an approach to make a high-density connector by introducing the use of printed circuit boards. Conductive traces are formed on surfaces of the printed circuit board in a mirror-image arrangement, typically shown in FIG. 12.

U.S. Pat. No. 6,267,604 issued to Mickievicz et al. discloses a similar configuration.

U.S. Pat. No. 5,356,301 issued to Champion et al. discloses a pair of back-to-back arranged plug connectors mounted on opposite sides of a motherboard via common contacts for respectively connecting with a receptacle connector mounted on a daughterboard and a cable connector.

However, all connectors suggested above are all mounted on the backplane or centerplane. As it is well known that if the centerplane can be eliminated such that the daughterboards can be directly interconnected with each other, then the signal attenuation as well as the interference can be largely reduced. However, none of the connectors provided yet meets such a requirement.

U.S. Pat. No. 6,540,522 (the '522 patent) issued to Sipe sheds light on eliminating the centerplane, i.e. two daughterboards can be interconnected orthogonally, as clearly shown in FIG. 9. This is really a leap step.

However, the signal still travels a long distance from one end of a first connector on a first circuit board, to a second connector on a second circuit board. This signal attenuation is still left unsolved. On the other hand, all these above mentioned connectors could be mounted on a single side and along an edge of the motherboard as well as the daughterboards. As shown in FIG. 9 of the '522 patent, it is impossible to install a second set connectors on the opposite side of the boards.

Traditionally, if a contact defines a longitudinal direction, then a mating direction of an electrical component, i.e. a mating contact of a complementary connector or a conductive pad of a printed circuit board has to be the same direction as the contact. It is impossible to insert a card into a conventional card-edge connector where the insertion direction of the card is orthogonal to the contact within the connector. If the contacts are not well arranged, the insertion of the card will collapse the contacts within the connector. The contacts have to be retracted behind a mating face of the connector during the insertion of the card, and then extend beyond the mating face after the card arrives to its final position. None of the existing connectors meets such a requirement.

For example, U.S. Pat. No. 6,508,675, assigned to the same assignee with this patent application, discloses a configuration providing the shortest electrical path between two orthogonally arranged printed circuit boards. It can be easily appreciated, as shown in FIGS. 1 and 2, that if the printed circuit board is not inserted into a slot of a connector along a top-to-bottom direction, i.e. a vertical direction, viewed from the drawings, contact portions of contacts extending into the slot will surely be damaged by the insertion of the circuit board.

In order to let the circuit board be inserted into the slot from a direction other than the top-to-bottom direction, a mechanism has to be invented to control the contact such that the contact is retracted behind the mating face when the printed circuit board is inserted and extends over the mating face after the printed circuit board is finally positioned.

The present invention aims to provide an electrical interconnection system to solve the above-mentioned problems.

SUMMARY OF THE INVENTION

It is an object of the present invention to provide an interconnection system between a plurality of orthogonally arranged printed circuit boards in which a shortest electrical path is reached.

It is still an object of the present invention to provide an interconnection system between orthogonally arranged printed circuit boards, in which at least an electrical connector is arranged in a quadrant defined between two orthogonally arranged printed circuit boards.

It is still an object of the present invention to provide an interconnection system in which two orthogonally arranged printed circuit boards are intersected so as to define an intersecting line.

It is still an object of the present invention to provide an electrical connector allowing a printed circuit board to be inserted in a direction perpendicular to a longitudinal direction of a contact thereof.

In order to achieve the objects set forth, an electrical interconnection system in accordance with the present invention comprises a first printed circuit board defining a receiving slot, a second printed circuit board assembled to the first printed circuit board and having an edge received in the receiving slot, and an electrical connector comprising contacts electrically connecting with the first and the second printed circuit boards.

According to one aspect of the present invention, the connector is mounted on the second printed circuit board and has a mating face and a mounting face perpendicular to each other. Each electrical contact of the connector includes a first end electrically contacting with the first printed circuit board, and a second end electrically contacting with the second printed circuit board. An actuator is associated with the electrical connector and includes a base defining a plurality of holes in which the second ends of the electrical contacts are received. The actuator is actuated to move from a first position in which the first ends of the contacts are substantially extend to the mating face for easy insertion of the first printed circuit board, and a second position in which the first ends of the contacts are fully extended beyond the mating face so as to establish an electrical connection between the first and the second printed circuit boards.

Still according to another aspect of the present invention, an electrical connector for electrically interconnecting two printed circuit boards comprises a dielectric housing defining first and second faces perpendicular to each other and a plurality of passageways extending from the first face to the second face. A plurality of electrical contacts each is moveably received in a corresponding passageway and each includes a first end extending beyond the first face and a second end extending beyond the second face. An actuator is associated with the housing and defines a plurality of holes receiving the first ends of the contacts so as to actuate the contacts to move in the passageways.

Still according to another aspect of the present invention, it is yet provided with a method for electrically interconnecting a plurality of horizontally arranged stationary boards and a plurality of vertically arranged removeable boards. The method comprises the steps of: a) providing a stationary board; 2) providing a removeable board; 3) providing a receiving slot in one of the stationary and the removeable boards; and 4) providing an electrical connector arranged adjacent to the receiving slot to thereby electrically interconnecting the stationary and the removeable boards.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the preferred embodiments of the present invention, will be better understood when read in conjunction with the appended drawings. For the purpose of illustrating the invention, there is shown in the drawings, embodiments which are presently preferred. It should be understood, however, that the present invention is not limited to the precise arrangements and instrumentality shown in the attached drawings.

DETAILED DESCRIPTION OF THE PREFERRED EMBODIMENT

Reference will now be made in detail to the preferred embodiment of the present invention.

Figure 1:
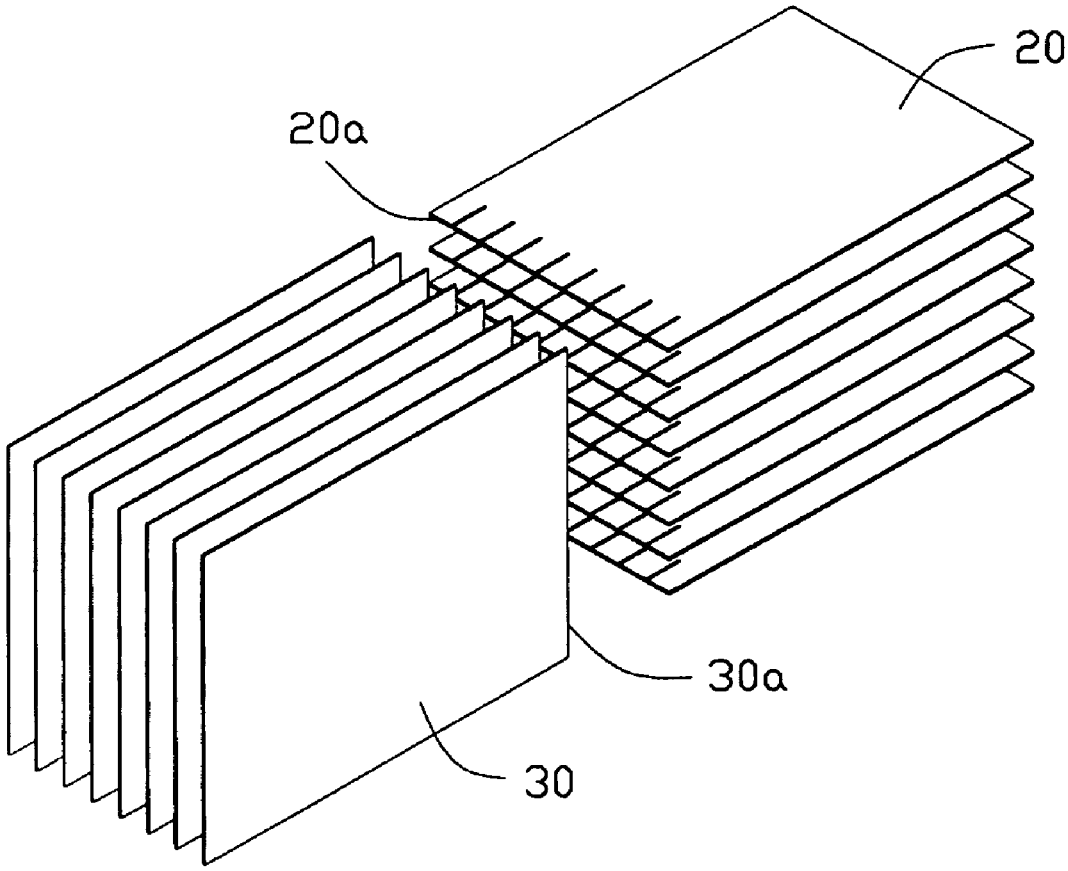
FIG. 1 is an illustration of a solution provided by the present invention in which a plurality of stationary boards each is provided with a plurality of slots for receiving multiple removeable daughter boards.
Figure 2:
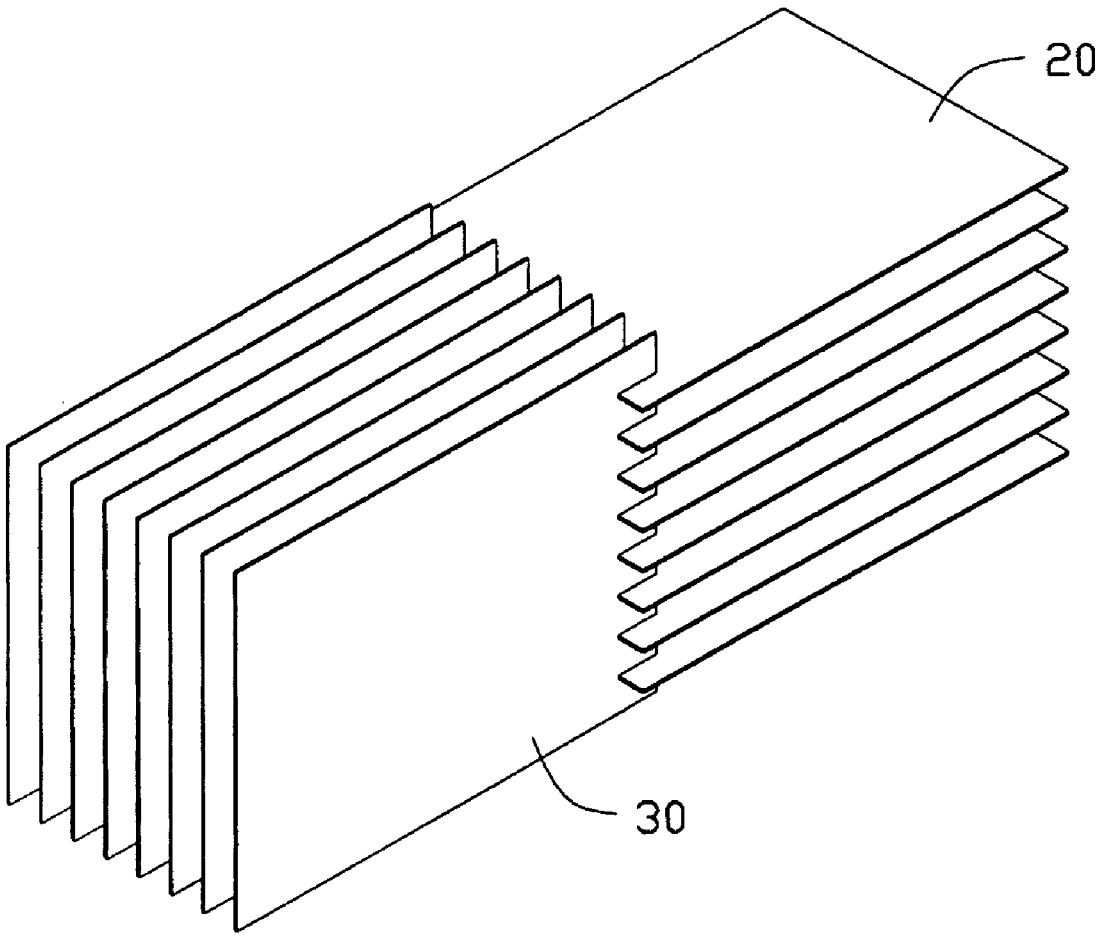
FIG. 2 is an assembled view of FIG. 1.
Figure 3:
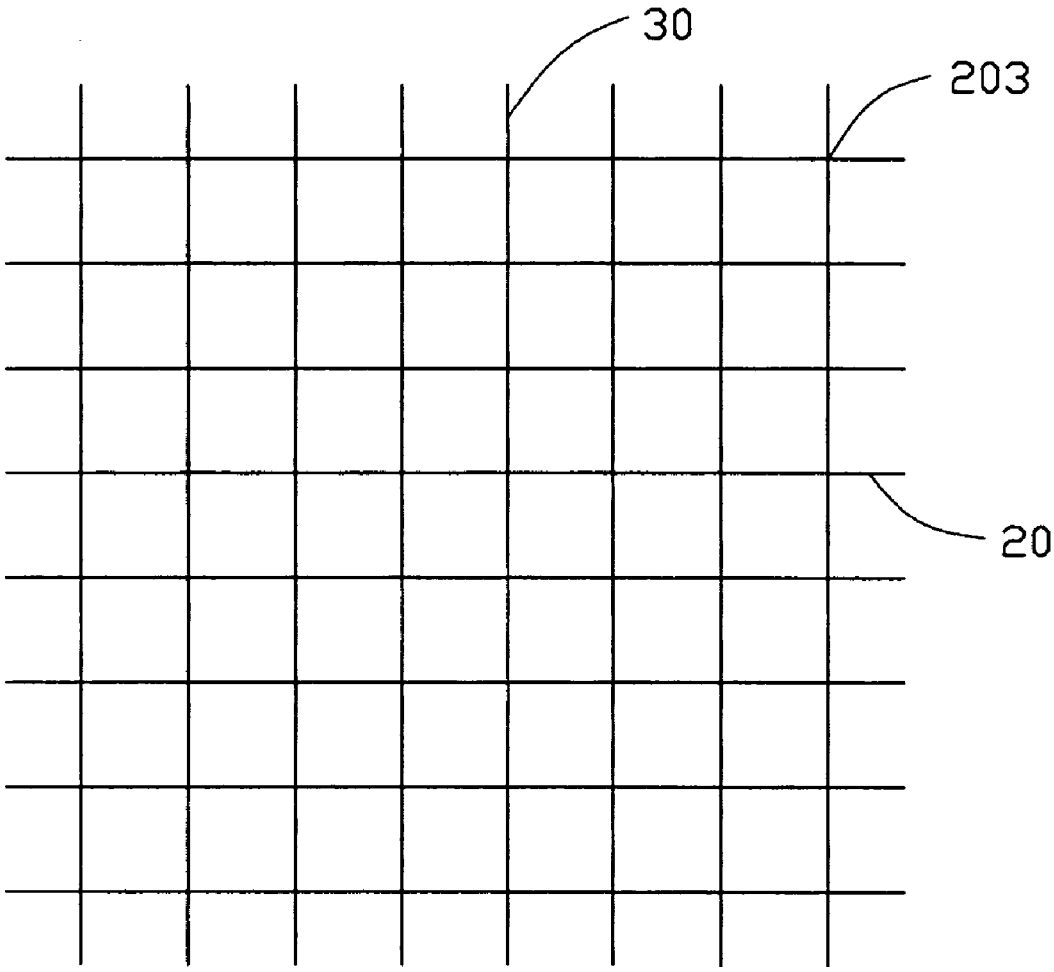
FIG. 3 is an end view of FIG. 2.

Referring to FIGS. 1, 2 and 3, a plurality of horizontal boards 20 and a plurality of vertical boards 30 are intersected with each other to form a plurality of interconnections or nodes 203 therebetween. For discussion purpose, the horizontal board 20 is referred to as the "stationary board", while the vertical board 30 is referred to as the "removeable board".

Figure 4:
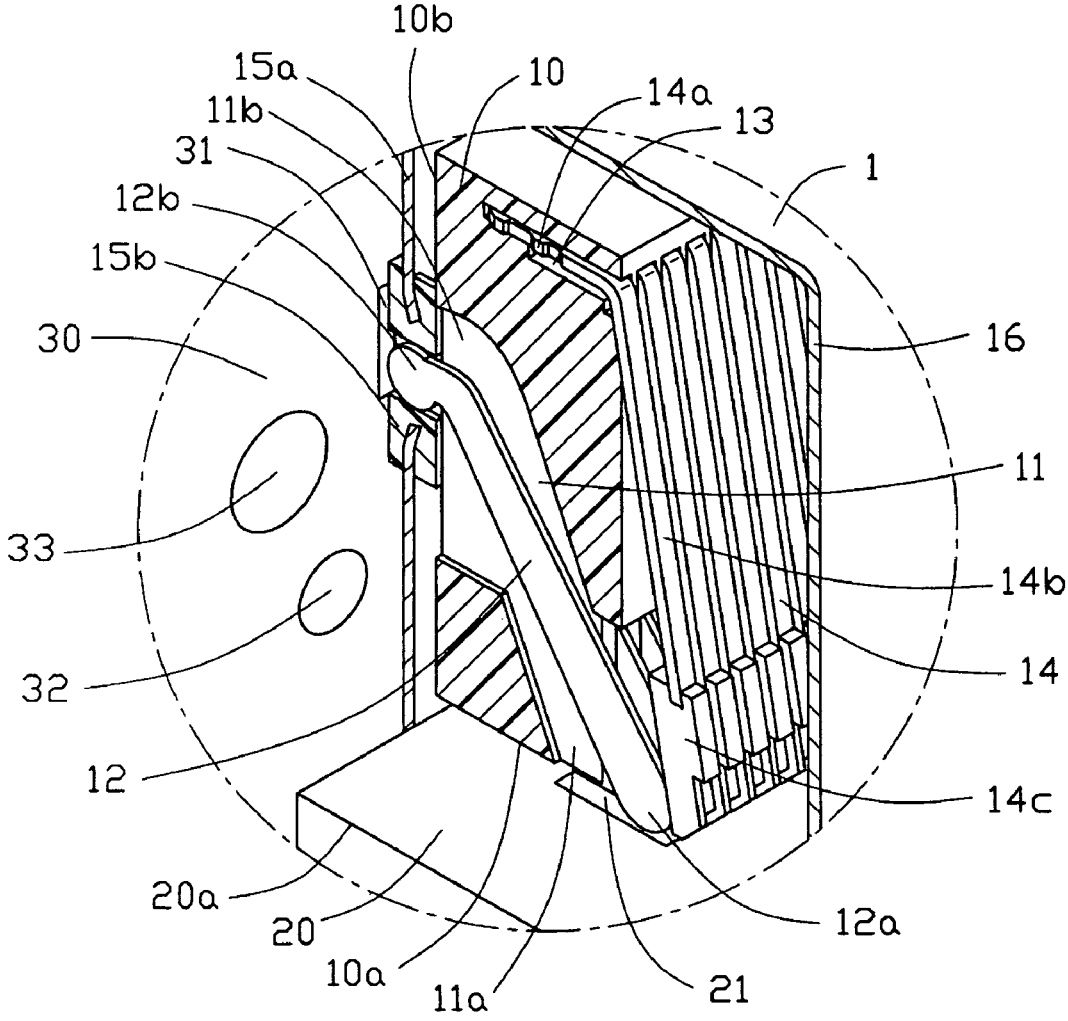
FIG. 4 is a partial, cut-away view showing the stationary board (horizontal) and the removeable board (vertical) are electrically interconnected by a connector made in accordance with the present invention.
Figure 5:
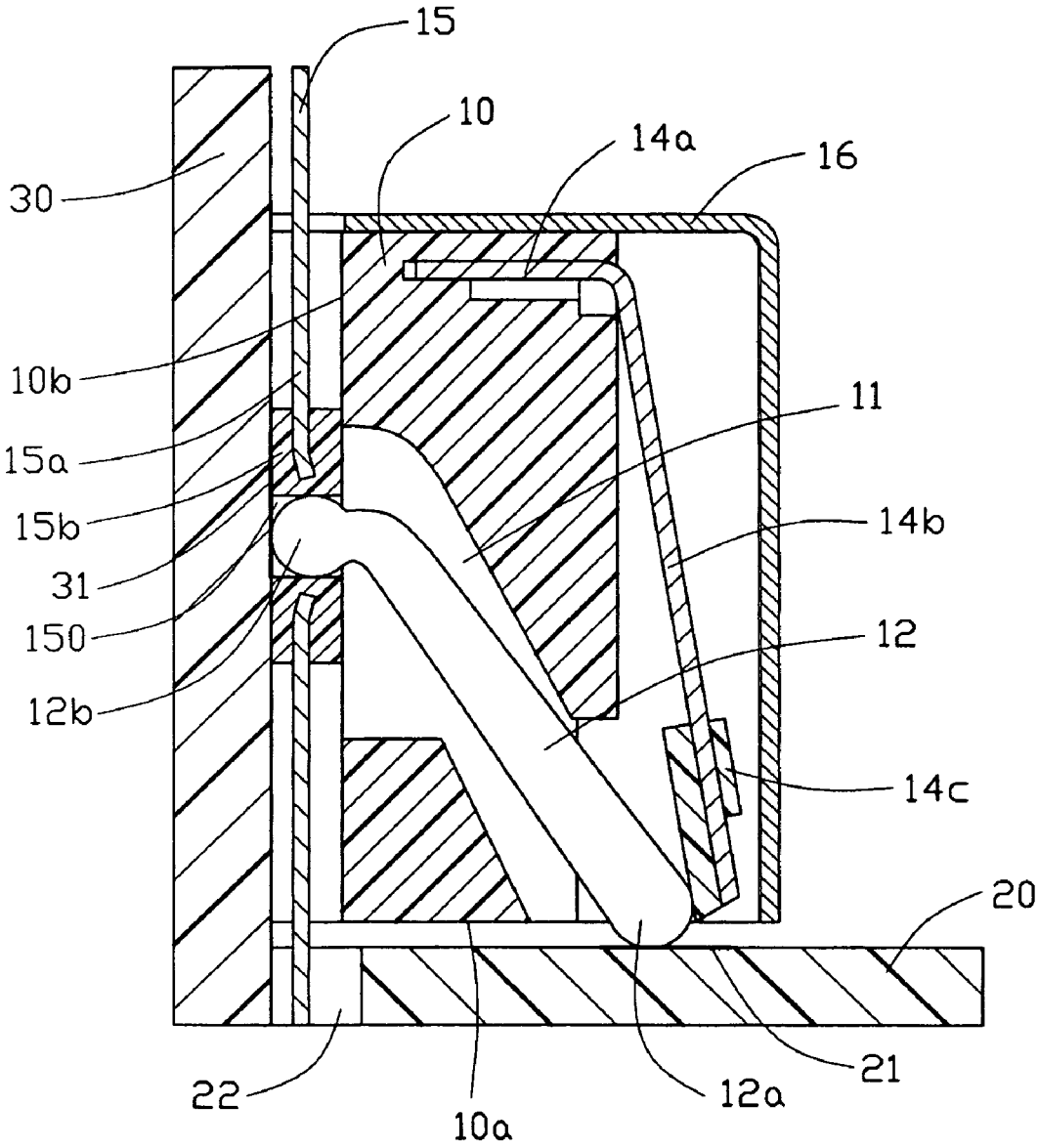
FIG. 5 is a cross-sectional view of FIG. 4.

Referring to FIGS. 4 and 5, an electrical connector 1 in accordance with the present invention is provided to electrically interconnect the stationary board 20 and the removeable board 30. The connector 1 comprises a dielectric housing 10 defining a plurality of passageways 11 between a mating face 10*a* and a mounting face 10*b* adjacent to each other, and a plurality of contacts 12 moveably received in the passageways 11. That is, the contacts 12 are moveable with respect to the housing 10. It is noted that the contacts 12 being moveable with respect to the housing 10 also include a pivotal design fixed at a certain point or a fixed design with a moveable part and etc as long as the contacts 12 can move along the stationary board 20, in addition to the design described hereinafter.

Each contact 12 includes a first contacting end 12*a* extending over the mating face 10*a* and a second contacting end 12*b* extending over the mounting face 10*b*. The passageway 11 is designed to have open ends 11*a*, 11*b* such that the first contacting end 12*a* and the second contacting end 12*b* of the contact 12 can move along the mating face 10*a* and the mounting face 10*b*, respectively. The contact 12 is stamped from a sheet of metal. According to a preferred embodiment, the contact 12 is preferable rigid or less flexibility. The physical property makes the contact 12 easily to move within the passageway 11 when an external force is applied to the contact 12.

The electrical connector 1 further includes a plurality of biasing springs 14. Each biasing spring 14 includes an anchor 14*a* securely retained in an anchoring slit 13 of the dielectric housing 10, a spring arm 14*b* extending from the anchor 14*a* and an insulator 14*c* connecting with a free end of the spring arm 14*b*. The insulator 14*c* can be integrally formed with the spring arm 14*b*, or can be firstly molded and then assembled to the spring arm 14*b*. The plurality of biasing springs 14 can also be integrated as a single one. The insulator 14*c* of the biasing spring 14 provides a biasing force to the first end 12*a* of the contact 12.

The electrical connector 1 is further provided with an actuator 15 moveably arranged along the mounting face 10*b*. The actuator 15, according to the preferred embodiment, includes a main body 15*a* made of a metal sheet and a dielectric boot 15*b* connecting with the main body 15*a*. The dielectric boot 15*b* define a plurality of holes 150 receiving therein the second contacting ends 12*b* of the contacts 12. Accordingly, when the actuator 15 is moved downward along the mounting face 10*b* of the housing 10, the second contacting end 12*b* of the contact 12 is moved downward along the mounting face 10*b*, while the first contacting end 12*a* of the contact 12 moves away from the removeable board 30. As mentioned above, the biasing spring 14 provides a driving force to the contact 12. As such, when the contact 12 is moved with the movement of the actuator 15, the first end 12*a* and the second end 12*b* of the contact 12 provide a wiping contact with respect to corresponding conductive pads 21, 31 on the stationary board 20 and the removeable board 30.

Figure 10:
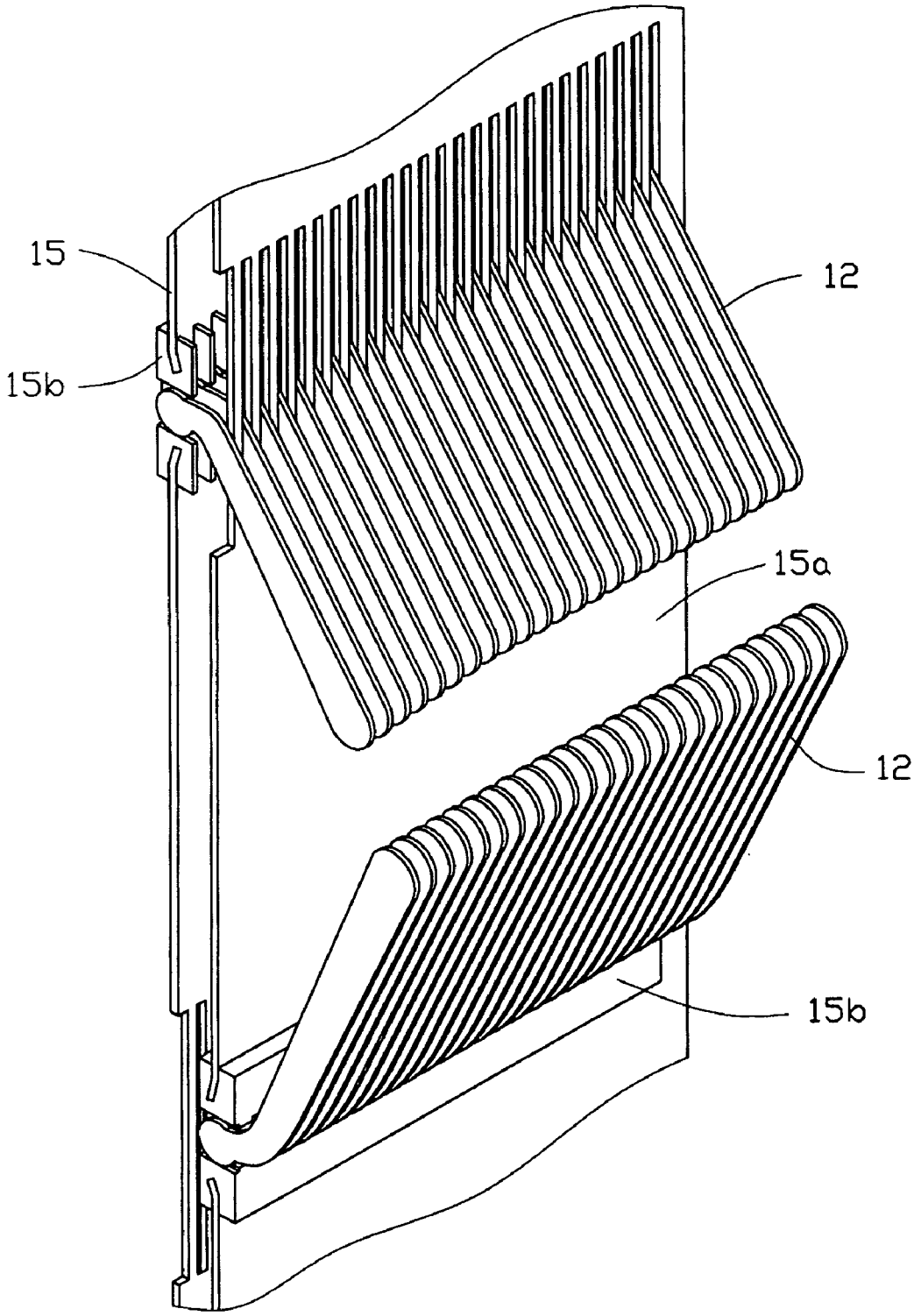
FIG. 10 shows a relationship between the contacts and the actuators.
Figure 11:
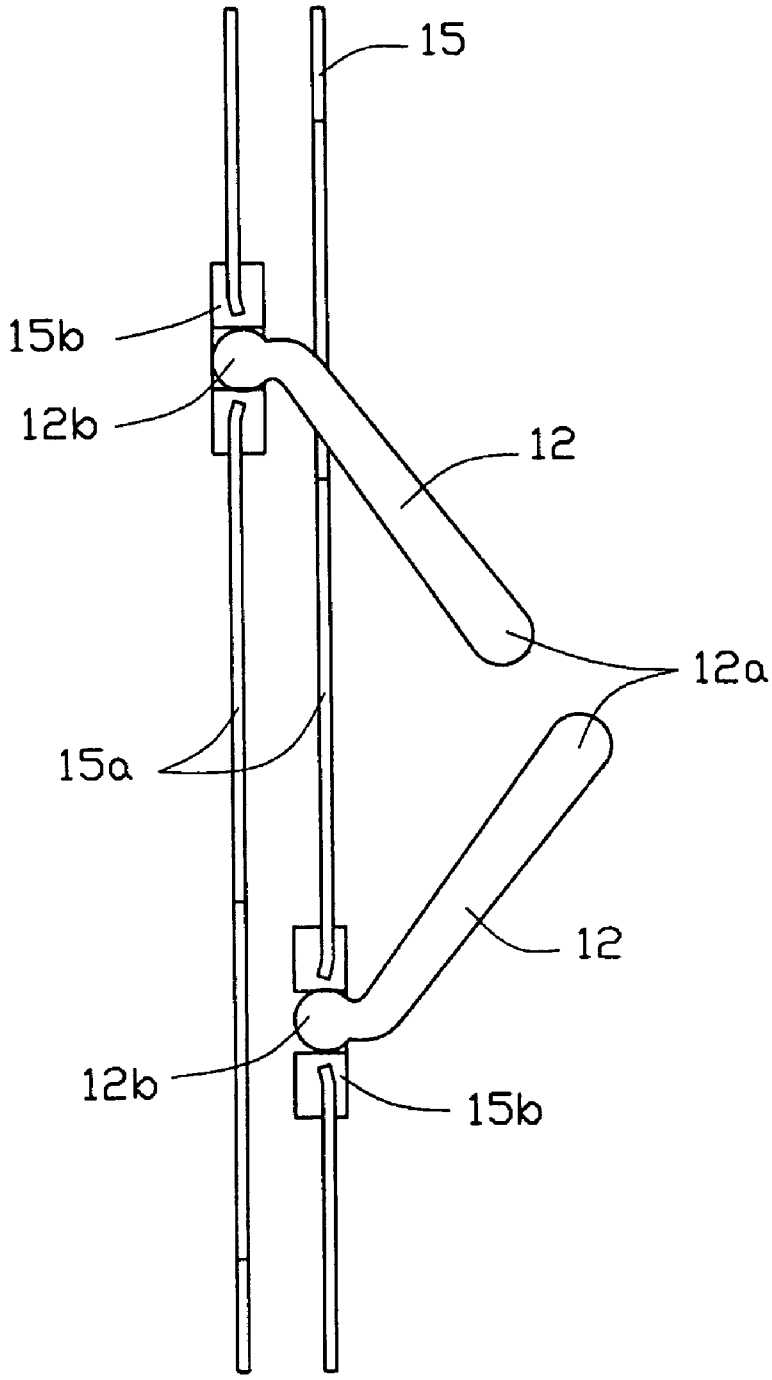
FIG. 11 is a side view showing an end of the contact engaging with a dielectric boot of the actuator.

As clearly shown in FIGS. 10 and 11, the second end 12*b* of the contact 12 is connected with the boot 15*b* of the actuator 15. As such, when the actuator 15 is moved, the contact 12 is moved accordingly.

The electrical connector 1 further includes a metal shell 16 attached to the housing 10 and shielding the contacts 12 from being influenced by electromagnetic interference.

Figure 12:
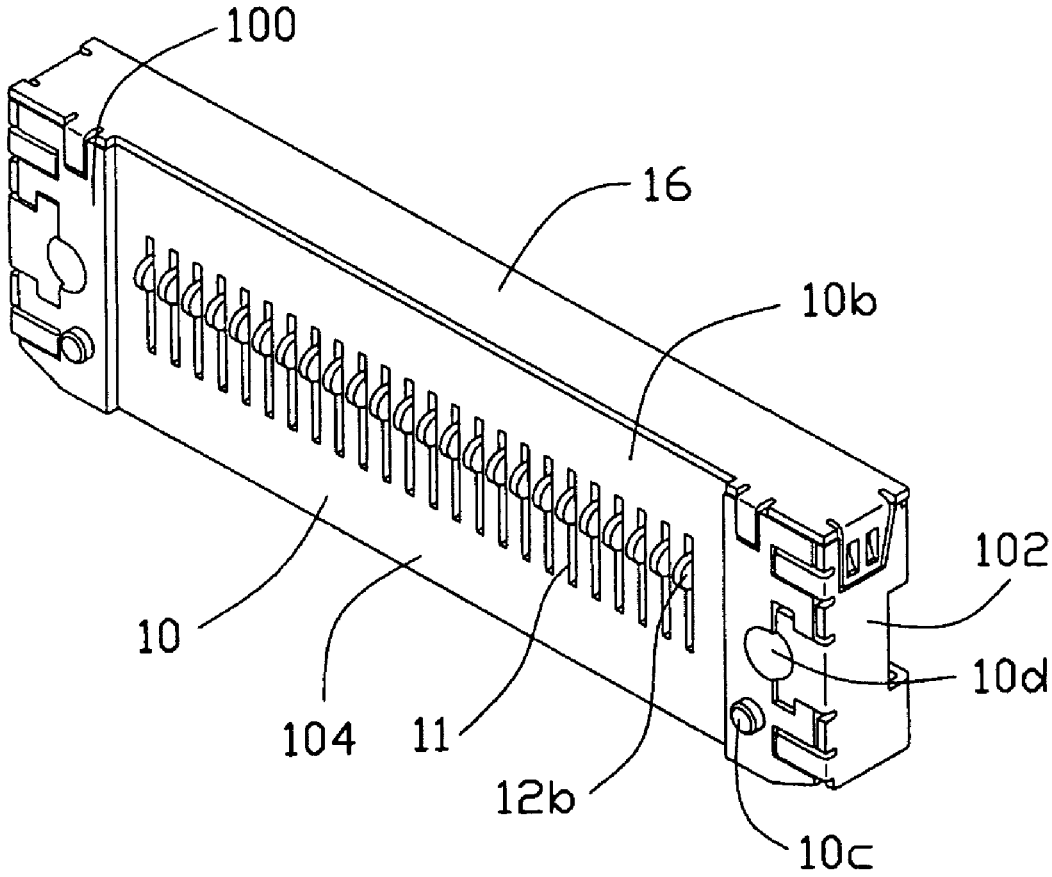
FIG. 12 is a perspective view of the connector, prior to the assembly of the actuator.
Figure 13:
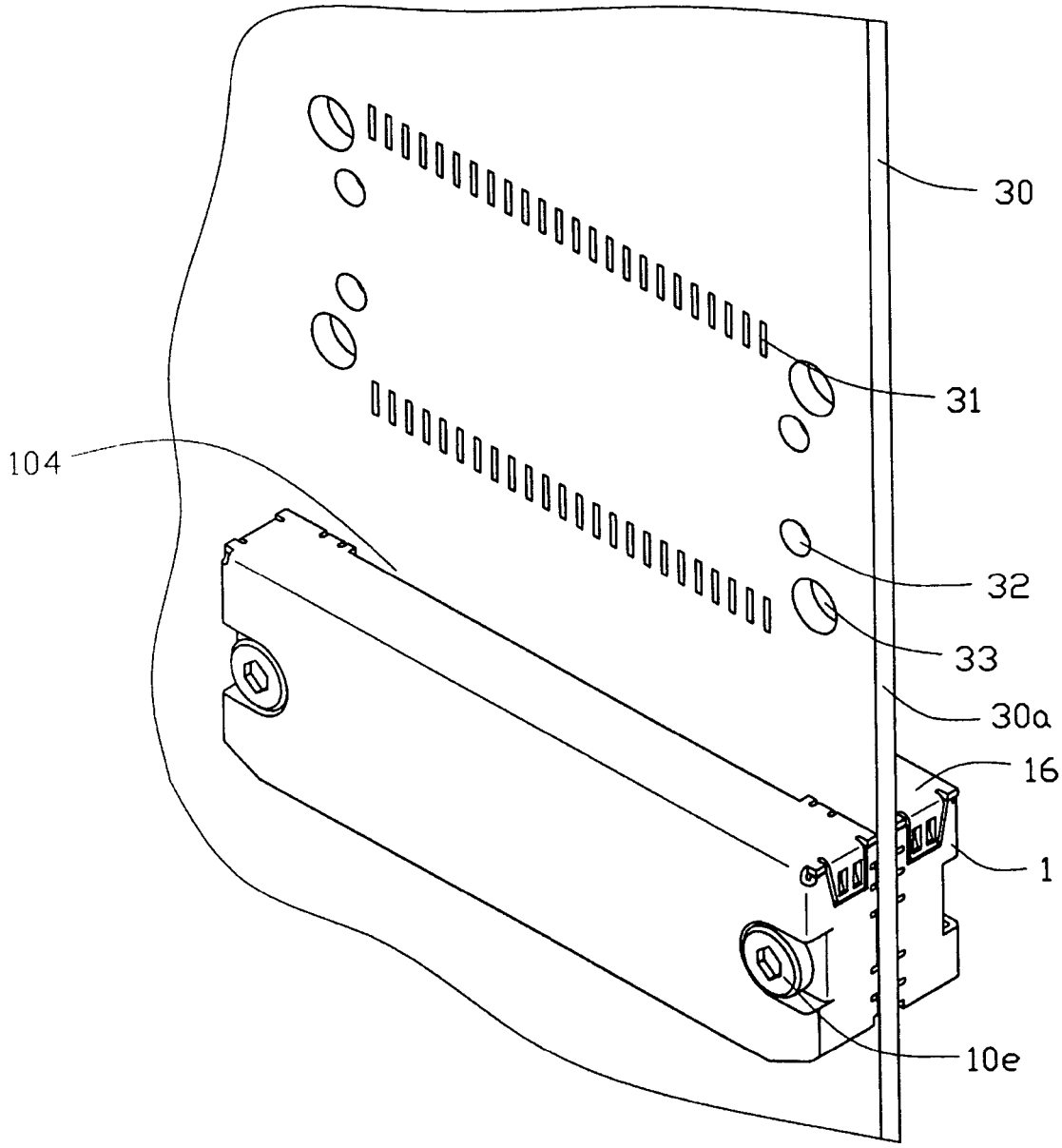
FIG. 13 is a perspective view showing conductive pads and holes are arranged on the removeable board and showing two connectors are mounted on the removeable board.

Referring to FIGS. 12 and 13, the housing 10 has a pair of projections 100 formed on the mounting face 10*b* adjacent opposite sides 102 of the housing 10. The pair of projections 100 defines a cavity 104 therebetween for receiving the actuator 15. The housing 10 is formed with a pair of positioning pins 10*c* for positioning the connector 1 on the removeable board 30 and defines a pair of through holes 10*d* receiving a pair of locking bolts 10*e* for securely attaching the connector 1 to the removeable board 30. Accordingly, the shell 16 can be grounded to the removeable board 30 or the stationary board 20.

Figure 6:
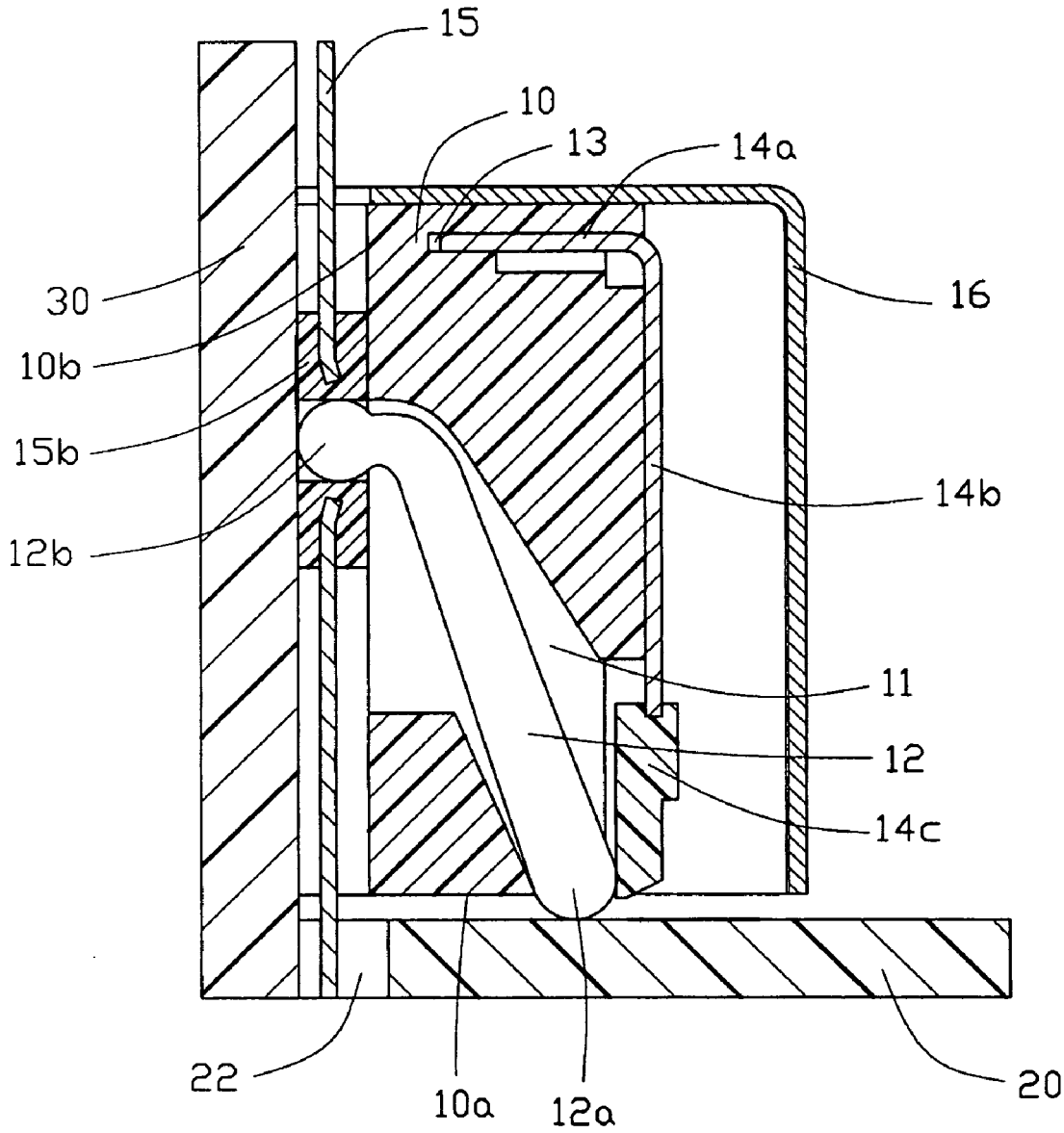
FIG. 6 is an illustration before actuation of an actuator.
Figure 7:
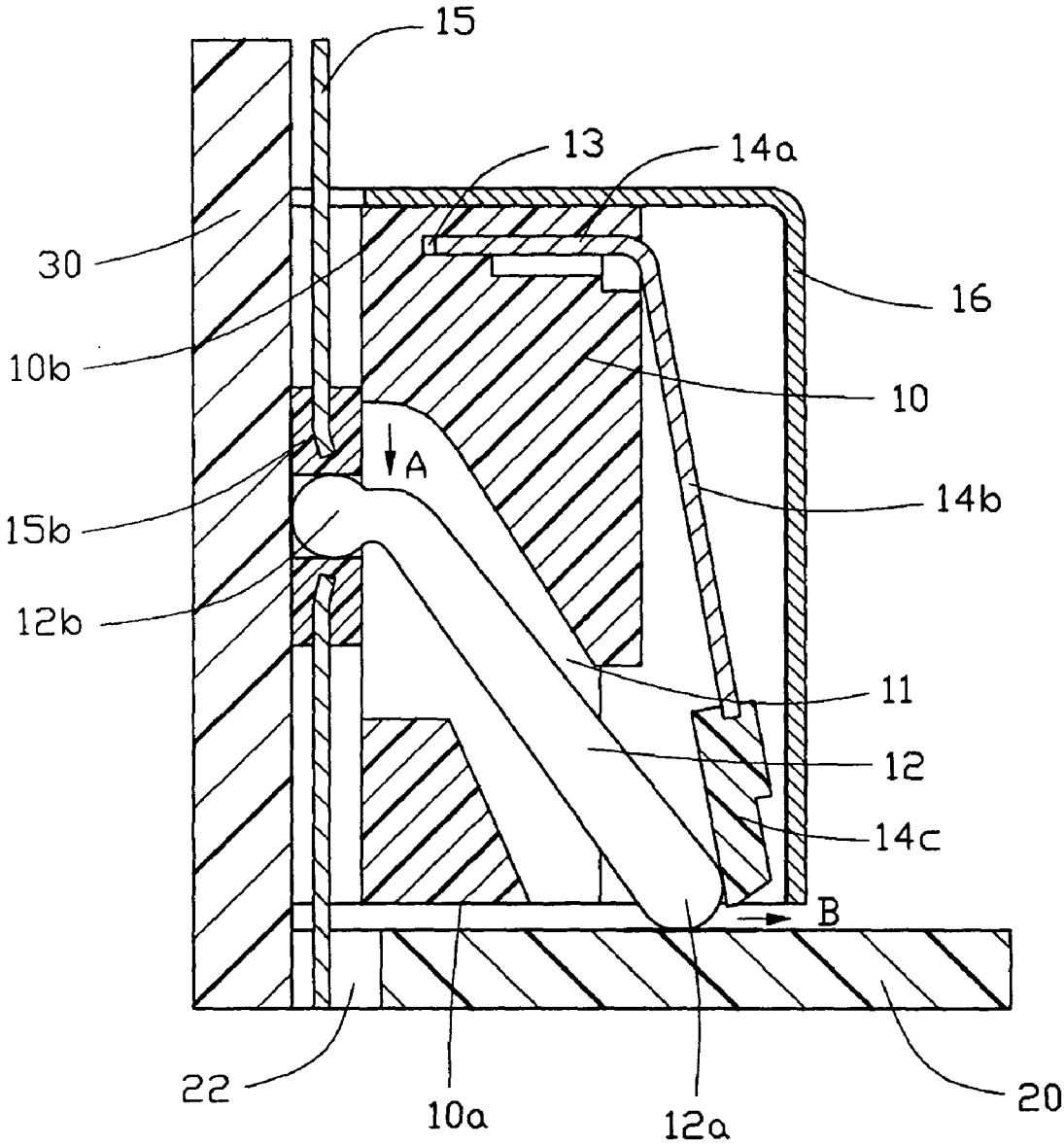
FIG. 7 is an illustration after actuation of the actuator, showing a contact coupled with the actuator moving downwardly and outwardly marked by arrows A and B.

FIGS. 6 and 7 illustrate the movement of the contact 12 within the passageway 11 of the housing 10 when the actuator 15 is actuated. As shown in FIG. 6, the removeable board 30 is intersected with the stationary board 20. When the connector 1 is securely mounted on the removeable board 30, the contact 12 is normally pushed toward the conductive pad 31 of the removeable board 30 by the driving force applied to the contact 12 from the biasing spring 14. In this position, the second end 12*b* of the contact 12 is located in a highest position within the passageway 11 and the spring arm 14*b* is substantially perpendicular to the stationary board 20.

When the actuator 15 is moved downward, the second ends 12*b* of the contacts 12 are moved downward as illustrated by arrow A with the movement of the boot 15*b*. Accordingly, the first ends 12*a* of the contacts 12 are moved along the stationary board 20 in a direction away from the removeable board 30 as illustrated by arrow B. The spring arm 14*b* provides a driving force to the first end 12*a* of the contact 12 to thereby hold the actuator 15 in position. By this arrangement, the first ends 12*a* and the second ends 12*b* of the contacts 12 electrically abut against the conductive pads 21, 31 of the stationary board 20 and the removeable board 30, respectively. Accordingly, an electrical connection is established between the stationary board 20 and the removeable board 30 through the connector 1.

As clearly shown in FIG. 7, the first end 12*a* of the contact 12 moves along the stationary board 20 in a first direction and the second end 12*b* of the contact 12 moves along the removeable board 30 in a second direction which is perpendicular to the first direction. This is a great leap advancing the achievement of solving the long-expected but unsolved market demanding. By the provision of the connector 1 in accordance with the present invention, the long-expected request has been finally solved.

Referring to FIG. 13, the removeable board 30 defines a pair of positioning holes 32 receiving therein the positioning pins 10*c* of the connector 1 and a pair of mounting holes 33 receiving therein the pair of locking bolts 10*e* for mounting the connector 1 on the removeable board 30. The conductive pads 31 are arranged on opposite side faces of the removeable board 30 between the pair of mounting holes 33. For description purpose, the conductive pads 31, the positioning holes 32 and the mounting holes 33 are collectively referred to as "footprints".

Figure 8:
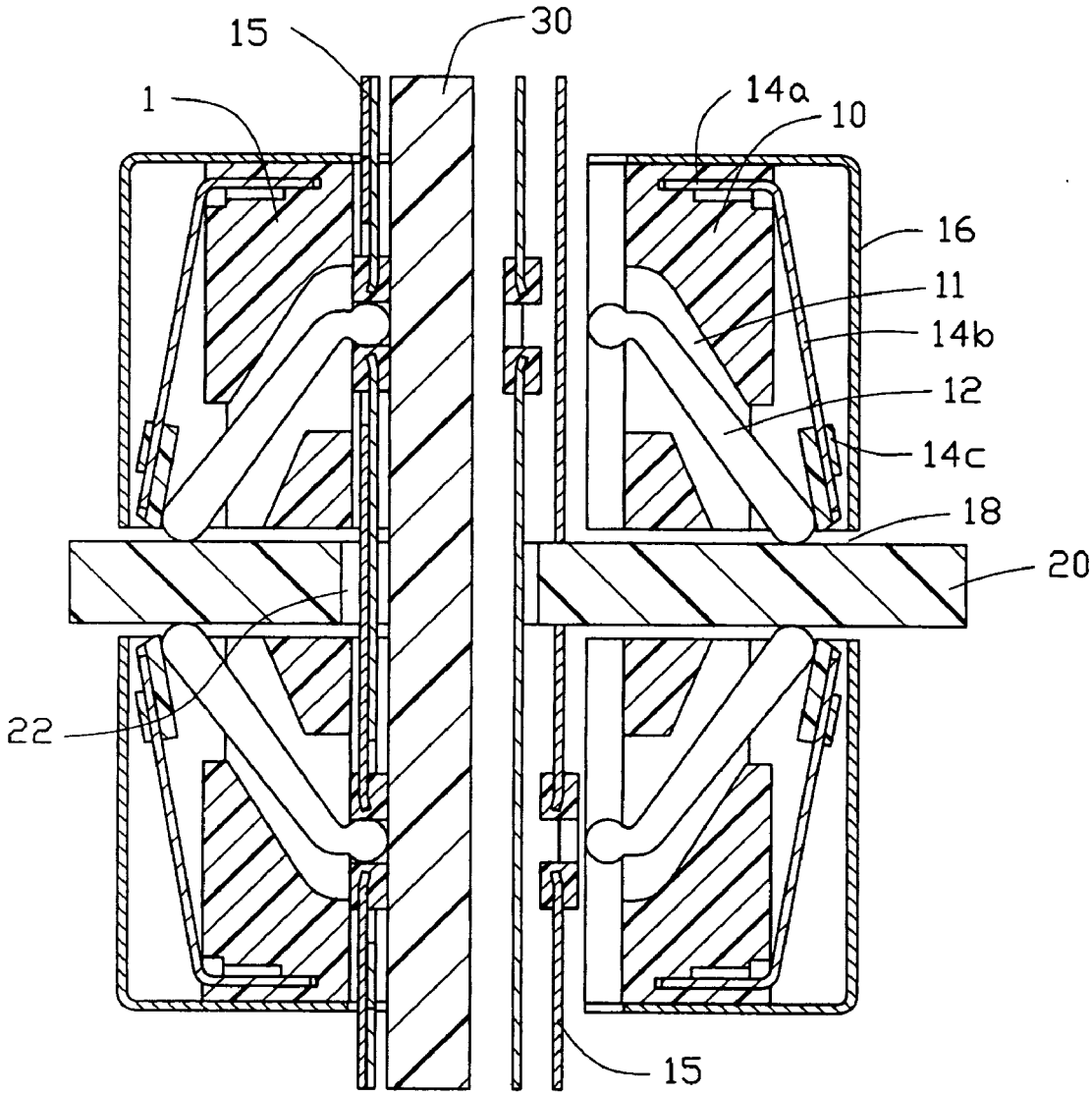
FIG. 8 is an illustration showing the stationary board and the removeable board are electrically interconnected by four connectors, in which two connectors are away from the removeable board for illustration.
Figure 9:
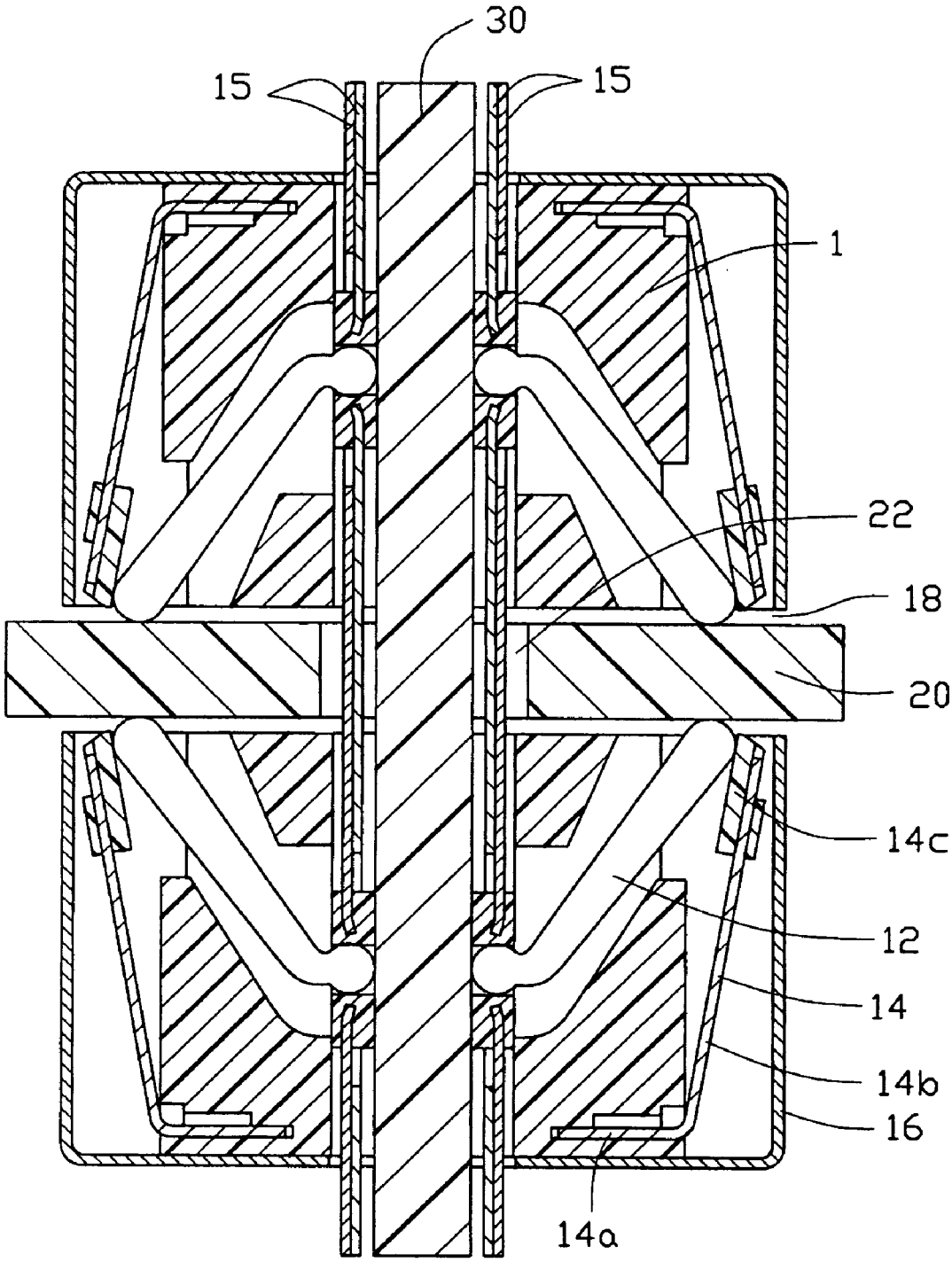
FIG. 9 is a view similar to FIG. 8 but showing the four connectors are finally positioned.

Referring to FIGS. 8 and 9 in conjunction with FIG. 13, the "footprints" are arranged in such manner that two connectors 1 are mounted on one side of the removeable board 30 in a substantially mirror-image manner. These two connectors 1 are spaced apart from each other to define a receiving channel 18 therebetween. The receiving channel 18 is adapted to receive the stationary board 20.

Figure 14:
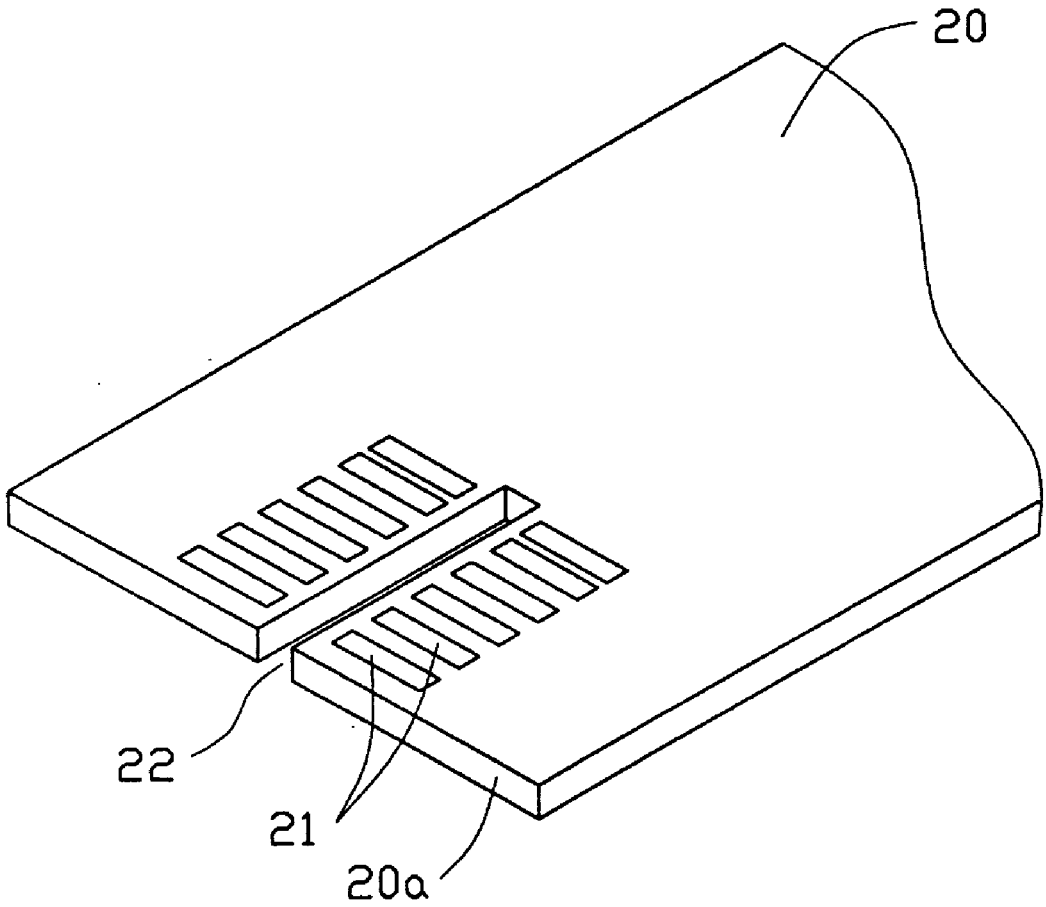
FIG. 14 is a perspective view showing the slot on the stationary board and conductive pads arranged therealong.

Referring to FIG. 14 in conjunction with FIG. 4, the stationary board 20 defines a receiving slot 22 extending from an edge 20*a* thereof to receive an edge 30*a* (FIGS. 1 and 13) of the removeable board 30 to make the stationary board 20 be readily received into the channel 18, thereby establishing the electrical connection between the removeable board 30 and the stationary board 20 via the connector 1. The conductive pads 21 are arranged along the receiving slot 22. As shown in FIG. 9, when the stationary board 20 and the removeable board 30 are intersected with each other, four connectors 1 can be used to interconnect the stationary board 20 and the removeable board 30. This provides a robust flexibility to a system designer as the designer can readily select the numbers for the interconnections therebetween so as to achieve the enhanced electrical performance.

From a view point of math, four quadrants are defined by the stationary board 20 and the removeable board 30. In the preferable embodiment, four connectors 1 are provided to be each located at a corresponding quadrant. It can be readily appreciated that the numbers of the connectors 1 can be specially selected according to the actual requirement. For example, the removeable board 30 can be provided with only two connectors 1 respectively located at first and second quadrants or first and third quadrants or first and fourth quadrants. This provides a high flexibility of the interconnection between the stationary board 20 and the removeable board 30.

Figure 15:
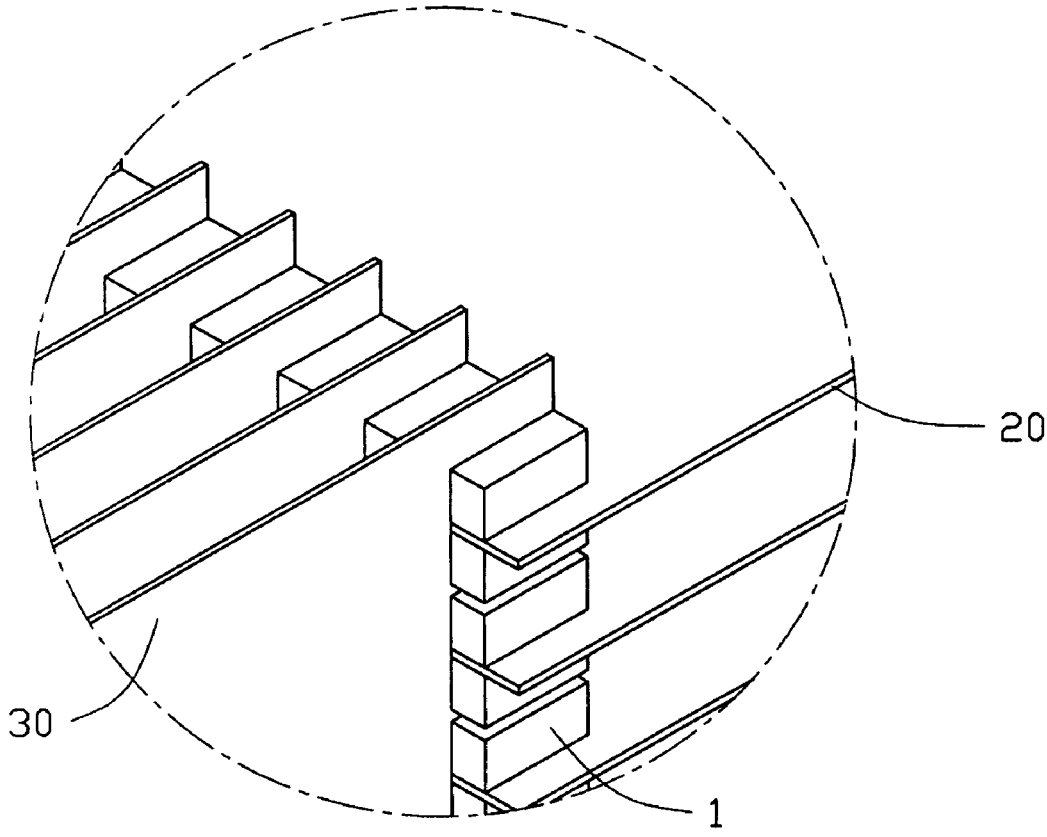
FIG. 15 is a perspective view showing the connectors mounted on the stationary and the removeable boards.
Figure 16:
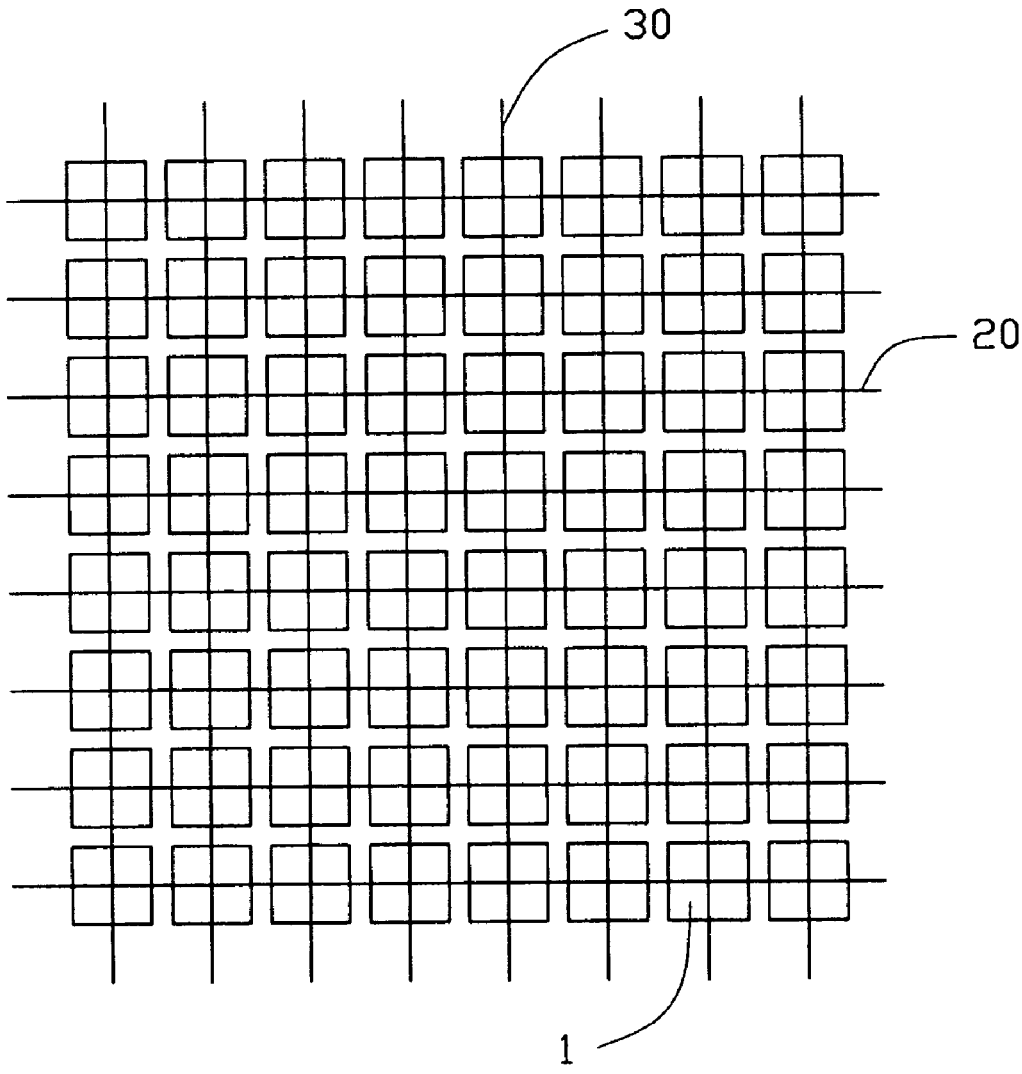
FIG. 16 is a schematic view showing the stationary and the removeable boards are interconnected by the connectors.

Referring to FIGS. 15 and 16, in this embodiment, each quadrant is provided with a connector 1. However, it is not imperative that each quadrant be mounted with a connector 1. It all depends on the actual requirements and implementations. By this arrangement, there is a good flexibility for the designer to arrange the interconnection between the removeable board 30 and the stationary board 20.

The connector 1 in accordance with the present invention can be made in various ways. In this embodiment, the housing 10 of the connector 1 is first formed with the passageways 11, the contacts 12 are then inserted into the passageways 11 and the biasing springs 14 are assembled to the housing 10. Finally, the shell 16 is attached to the housing 10 to partially enclose the housing 10.

It is noted that the connector 1 can be configured by a plurality of wafers as teaching in U.S. Pat. No. 6,508,675. Each wafer may define the passageway 11 receiving the contact 12 therein. The biasing spring 14 can be assembled to the wafer as well. Finally, the wafers are assembled together.

It is preferable to configure the connector 1 through the wafer arrangement. On the other hand, two contacts 12 can be received in one passageway 11 to serve as a differential pair. In this embodiment, the contact 12 can be a wire, such as a gold wire, encapsulated by insulative plastic material.

According to another aspect of the present invention, it is yet provided with a method for electrically interconnecting the horizontally arranged stationary board 20 and the vertically arranged removeable board 30. The method comprises the steps of: a) providing the stationary board 20 having the conductive pads 21; b) providing the removeable board 30 having the conductive pads 31; c) providing the receiving slot in one of the stationary board 20 and the removeable board 30; and d) providing the connector 1 located adjacent to the receiving slot to thereby electrically interconnecting the stationary board 20 and the removeable board 30.

It should be noted that the connector 1 can be arranged on the stationary board, i.e. motherboard 20, while the receiving slot is arranged on the removeable board 30, if necessary. The present invention provides a robust flexibility such that the designer can do whatever they want to do so as to achieve optimum electrical interconnections between the stationary boards 20 and the removeable boards 30.

It should be also noted that even the concept of the receiving slot, either only one or both boards being equipped with, is introduced so as to interconnect the stationary board 20 and the removeable board 30. Alternatively, the stationary board 20 can be provided with extended tabs having conductive pads thereon so as to make electrical interconnections with the removeable board 30 via the connector 1. As such, a variety of embodiments can be implemented within the scope of the invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical interconnection system, comprising:

a first printed circuit board defining a receiving slot;

a second printed circuit board having an edge received in the receiving slot of the first printed circuit board; and an electrical connector mounted to one of the first and the second printed circuit boards and comprising contacts each electrically connecting with the first and the second printed circuit boards wherein the connector comprises an actuator for applying a driving force to the contact to move a first end of the contact along the first printed circuit board and to move a second end of the contact along the second printed circuit board, wherein the connector has a mating face facing the first printed circuit board and a mounting face facing the second printed circuit board, and wherein the connector defines a plurality of passageways between the mating face and the mounting face and in which the contacts are moveably received.

2. The electrical interconnection system as recited in claim 1, wherein the actuator is engaged with the second end of the contact.

3. The electrical interconnection system as recited in claim 1, wherein the first and the second printed circuit boards respectively define a first plane and a second plane perpendicular to each other, and wherein the contacts defines a third plane serving as a hypotenuse of a triangle defined by the first, the second and the third planes.

4. The electrical interconnection system as recited in claim 1, wherein the first printed circuit board has first conductive pads arranged along the receiving slot, and wherein the second printed circuit board has second conductive pads arranged parallel to the edge of the second printed circuit board.

5. The electrical interconnection system as recited in claim 4, wherein the electrical connector is securely mounted on the second printed circuit board, and wherein the contacts moveably contact with the first and the second conductive pads of the first and the second printed circuit boards.

6. The electrical interconnection system as recited in claim 1, wherein the connector includes a biasing spring applying a driving force to the contact.

7. The electrical interconnection system as recited in claim 6, wherein the biasing spring is coupled to the first end of the contact.

8. An electrical interconnection system, comprising:

a plurality of first printed circuit boards;

a plurality of second printed circuit boards;

a plurality of receiving slots defined in each first printed circuit board, the first and the second printed circuit boards intersecting with each other through the slots to define a plurality of nodes each configured by first, second, third and fourth quadrants; and at least one electrical connector arranged in at least one of the four quadrants of each node to electrically interconnect the first and the second printed circuit boards.

9. The electrical interconnection system as recited in claim 8, wherein the at least one connector comprises a first connector arranged in the first quadrant and a second connector arranged in the fourth quadrant to have a substantially mirror-image relationship with the first connector.

10. The electrical interconnection system as recited in claim 9, wherein the first and the second connectors are mounted on the second printed circuit board, and wherein the first printed circuit board is electrically sandwiched between the first and the second connectors.

11. The electrical interconnection system as recited in claim 10, wherein the first connector comprises a first actuator having a first actuating direction, and the second connector comprises a second actuator having a second actuating direction opposite to the first actuating direction.

12. An electrical interconnection system, comprising:

a printed circuit board having a first surface;

a first group of conductive pads arranged on the first surface;

a second group of conductive pads arranged on the first surface and spaced from the first conductive pads;

a first electrical connector mounted on the printed circuit board over the first group of conductive pads and defining a first mating face, the first electrical connector comprising first contacts moveably contacting with the first conductive pads; and a second electrical connector mounted on the printed circuit board over the second group of conductive pads and defining a second mating face facing the first mating face, the second electrical connector comprising second contacts moveably contacting with the second conductive pads wherein the first and the second electrical connectors each comprise contacts and an actuator adapted for actuating end portion of the contact to electrically contact with the another printed circuit board.

13. The electrical interconnection system as recited in claim 12, wherein the first and the second mating faces define a first channel therebetween adapted for electrically receiving another printed circuit board therein.

14. The electrical interconnection system as recited in claim 12, further comprising a third and a fourth connectors mounted on a second surface of the printed circuit board, and wherein the third and the fourth connectors have a mirror-image relationship with the first and the second connectors, respectively.

15. The electrical interconnection system as recited in claim 14, wherein the third and the fourth electrical connectors define a second channel therebetween adapted for electrically receiving the another printed circuit board.

16. The electrical interconnection system as recited in claim 15, wherein the third and the fourth electrical connectors each comprise contacts and an actuator adapted for actuating the contacts to electrically contact with the another printed circuit board.

17. An electrical interconnection system comprising:

a first set of parallel printed circuit boards with thereof corresponding first front edge sections facing toward a first direction;

a second set of parallel printed circuit boards with thereof corresponding second front edge sections facing toward a second direction opposite to said first direction; and a first plane defined by each of said first set of printed circuit boards and a second plane defined by each of said second set of printed circuit boards being arranged in a non-parallel relation, said first front edge sections extending through said second set of printed circuit boards, and said second front edge sections extending through said first set of printed circuit boards; wherein said first set of printed circuit boards and said second set of printed circuit boards are interwoven with each other around said first front edge sections and said second front edge sections.

18. The system as recited in claim 17, wherein said first plane is perpendicular to said second plane.

19. The system as recited in claim 18, wherein said first set of printed circuit boards and said second set of printed circuit boards constitute a grid format from a viewpoint along a third direction perpendicular to a fourth direction defined by a first front edge of the first front edge section and a fifth direction defined by a second front edge of the second front edge section.

20. An electrical interconnection system comprising:

at least one first printed circuit board with thereof a corresponding first front edge section facing toward a first direction;

at least one second printed circuit board with thereof a corresponding second front edge section facing toward a second direction and also toward said first front section; and a first plane defined by said first printed circuit board and a second plane defined by said second printed circuit board being arranged in a non-parallel relation, said first front edge section and said second front edge section intersecting with each other; wherein an intersection line of said first front edge section and said second front edge section is perpendicular to both a first front edge of said first front edge section and a second front edge of said second front edge section.

21. The system as recited in claim 20, wherein said first front edge section and said second front edge section commonly define four quadrants sharing a common center line defined by said intersection line, and at least one electrical connector is located in one of said four quadrants and mounted to at least one of said first printed circuit board and said second printed circuit board while electrically connecting to both said first and second printed circuit boards.

22. The system as recited in claim 21, wherein said connector includes an array of contacts side by side arranged along a direction parallel to a direction defined by said intersection line.

23. The system as recited in claim 21, wherein non-parallel relation refers to a right angle relation.

24. The system as recited in claim 21, wherein said first direction and said second direction are opposite to each other.

* * * * *